US005106074A

United States Patent [19]

Nishigaki et al.

[11] Patent Number: 5,106,074

[45] Date of Patent: Apr. 21, 1992

[54] SHEET SUPPLYING APPARATUS HAVING SHEET STORING CASSETTE

[75] Inventors: Hideo Nishigaki; Toshio Sugiura, both of Nagoya, Japan

[73] Assignee: Brother Kogyo Kabushiki Kaisha, Nagoya, Japan

[21] Appl. No.: 599,511

[22] Filed: Oct. 18, 1990

[30] Foreign Application Priority Data

Dec. 28, 1989 [JP] Japan ..... 1-153187[U]
Dec. 28, 1989 [JP] Japan ..... 1-153188[U]

[51] Int. Cl.[5] ..... B65H 1/00
[52] U.S. Cl. ..... 271/162
[58] Field of Search ..... 271/264, 145, 147, 157, 271/162, 164, 171; 221/197, 242, 287; 355/311

[56] References Cited

U.S. PATENT DOCUMENTS 3,104,873 9/1963 Benson et al. ..... 271/171
3,934,870 1/1976 Miller et al. ..... 271/171
4,402,498 9/1983 Suzuki ..... 271/164
4,444,386 4/1984 Murata et al. ..... 271/171
4,825,251 4/1989 Nelson et al. ..... 355/74
4,826,147 5/1989 Shino et al. ..... 271/145
4,830,354 5/1989 Penson ..... 271/126
4,885,601 12/1989 Yui ..... 355/27
4,958,823 9/1990 Iwaki et al. ..... 271/164

*Primary Examiner*—David H. Bollinger
*Attorney, Agent, or Firm*—Oliff & Berridge

[57] ABSTRACT

A sheet supply system utilizes a cassette for holding a stack of sheets. The cassette includes an interlocking member formed on the bottom of the cassette which cooperates with an upstanding orienting member on a cassette receiving tray. The interlocking members permit orientation of the cassette on the tray in two positions, which are orthogonal to each other. Fringe marks on the tray delineate the marginal edge of cassettes to be placed on the tray, in each position the cassette can be oriented on the tray. The arrangement eliminates the need for movable guide members to position differently sized cassette on the tray or to position cassettes in different orientations on the tray.

16 Claims, 4 Drawing Sheets

SHEET SUPPLYING APPARATUS HAVING SHEET STORING CASSETTE

BACKGROUND OF THE INVENTION

1. Field of the Invention

This invention relates to a sheet supplying apparatus suitable for use on picture image forming machines, printers or the like, and more particularly to a sheet supplying apparatus which is provided with a cassette for storing a stack of sheets and a sheet feeder tray for holding the cassette in position.

2. Discussion of the Related Art

Heretofore, sheet supplying apparatus of this sort have been provided with a sheet cassette, a sheet feeder tray, and a positioning member for setting the cassette in position on the tray. The positioning member is usually located on the sheet feeder tray engageably with the outer periphery of the cassette.

With such a conventional sheet supplying apparatus, however, it has been required to change the positioning member every time a different sheet size is selected, because the size of the sheet cassette changes with the sheet size. Even in the case where a cassette of one size is used, it has been necessary to change the positioning member depending upon whether the cassette is used in a lengthwise or widthwise position.

SUMMARY OF THE PRESENT INVENTION

It is an object of the present invention to provide a sheet supplying apparatus which obviates the necessity for changing the positioning member on the sheet feeder tray in relation with the cassette size or cassette loading direction.

In order to achieve the above-stated objective, the sheet supplying apparatus according to the present invention comprises: a cassette adapted to store a stack of sheets; a sheet feeder tray for holding the cassette thereon; interlocking portions provided on the lower bottom surface of the cassette in perpendicularly intersecting relation with each other; and a positioning member provided on the top surface of the sheet feeder tray and adapted to engage with one of the interlocking portions to set the cassette in a predetermined position on the feeder tray.

The cassette can be set in a predetermined position on the sheet feeder tray upon engaging one of the perpendicularly intersecting interlocking portions on the bottom surface of the cassette with the positioning member on the sheet feeder tray. Accordingly, the sheet supplying apparatus of the present invention is capable of setting a cassette in position without necessitating change of the positioning member on the sheet feeder tray when the size or loading direction of the cassette is changed.

BRIEF DESCRIPTION OF THE DRAWINGS

The above and other objects, features and advantages of the invention will become apparent from the following description and the appended claims, taken in conjunction with the accompanying drawings which show by way of a preferred embodiment of the invention and in which:

FIG. 1(*b*) is a sectional view taken on line A—A of FIG. 1(*a*);

FIG. 3(*b*) is a sectional view taken on line B—B of FIG. 3(*a*); and

DETAILED DESCRIPTION OF THE PREFERRED EMBODIMENTS

Hereafter, the invention is described more particularly by way of a color copying machine incorporating a developer sheet supplying apparatus embodying the present invention.

Figure 4:
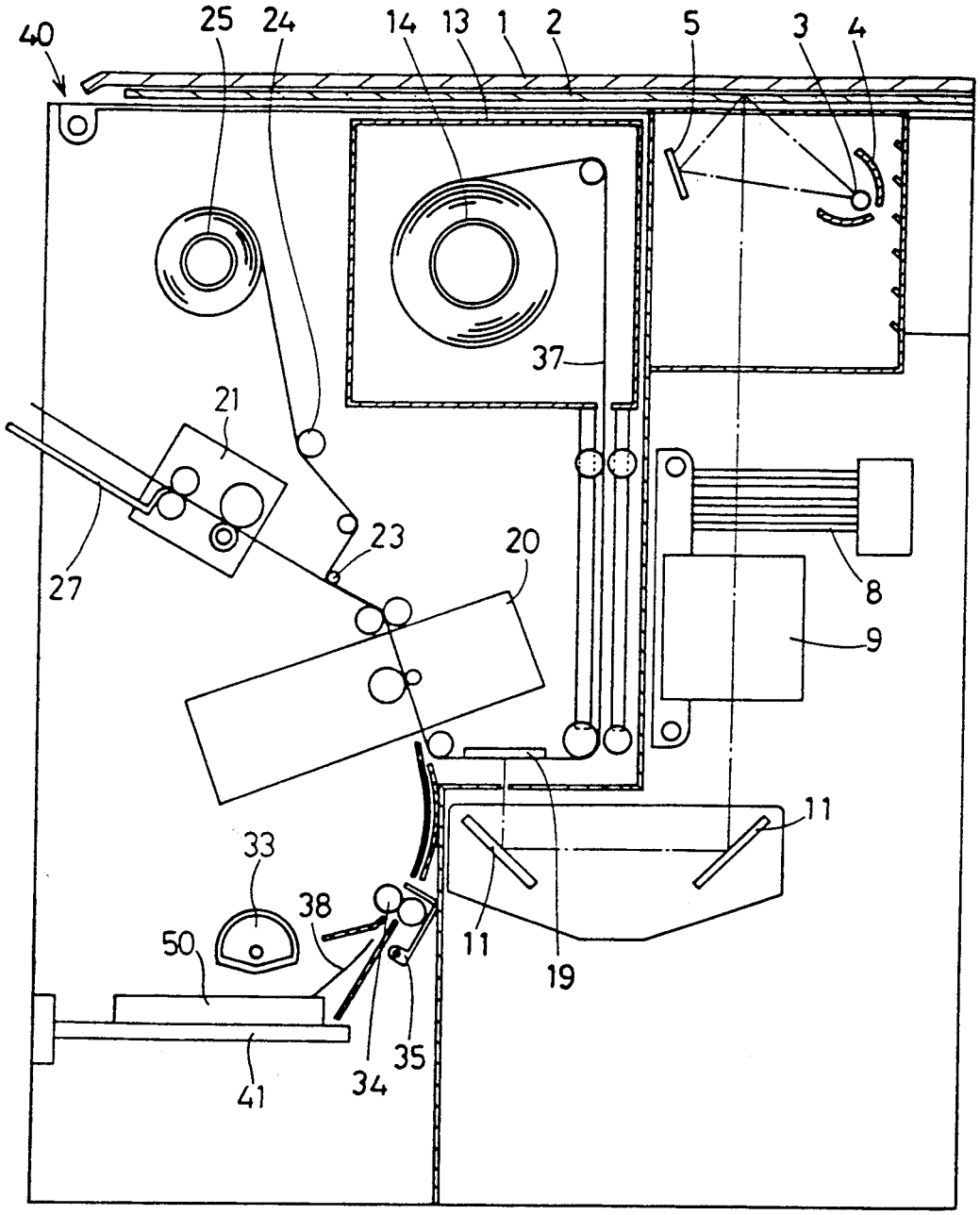
FIG. 4 is a schematic view of a full-color copying machine incorporating a sheet supplying apparatus according to the invention.

Referring to FIG. 4, there is illustrated a color copying machine 40 having on the top side thereof an original support glass 2 and an original cover 1, which are reciprocatingly movable in sideward directions. An original to be copied is placed upside down on the original support glass 2. Located in a right upper portion of the copying machine 40 is a light source, including a halogen lamp 3 which extends in a direction perpendicular to the direction of movement of the original support glass 2 and a semi-cylindrical reflecting mirror 4 which is fixed around the lamp 3, to direct light toward the original support glass 2 for line irradiation.

Accordingly, as the original support glass 2 is moved in a sideward direction, the light emitted from the halogen lamp 3 is sequentially shifted from one end to the other of the original support glass 2 to irradiate the entire surface thereof. The light projected from the light source is transmitted through the transparent original support glass 2, and reflected from surface of the original which is placed on the original support glass 2. The original cover 1 which is laid on the top surface of the original support glass 2 serves to prevent leakage of irradiating light through areas other than the original In order to utilize the light emitted from the halogen lamp 3 efficiently for irradiation of the original, a reflector 5 is positioned on the left side of the light source, thereby reflecting toward the original the light which is otherwise not shed directly in the direction of the original.

Upon irradiation by the halogen lamp 3, the light which is reflected from the original on the original support glass 2 is passed through a filter 8 to enter a lens 9.

The travel direction of the converging light from the lens 9 is turned 180° by a pair of reflecting mirrors 11 to form an image on a microcapsule sheet 37 which is held in intimate contact with the lower side of an exposure plate 19.

On the other hand, an elongated sheet of microcapsule paper 37, which is wound on a cartridge shaft !4, is accommodated in a detachable cartridge 13 which is located under the original support glass 2. One end of the microcapsule sheet 37 is led to a take-up shaft 25 via a large number of rollers and a pressing developer 20.

Namely, the microcapsule sheet 37 which is drawn out from the lower side of the cartridge 13 is fed to the pressing developer 20 past the lower side of the exposure plate 19. Therefore, the microcapsule sheet 37 which has come out of the pressing developer 20 is wound on the take-up shaft 25. Further, positioned beneath the pressing developer 20 is a sheet feeder tray 41 which can be pulled out to the left side of the machine in FIG. 4. A stack of cut type developer sheets 38 is stored in a cassette 50 which is placed on the sheet feeder tray 41. The developer sheets 38 are fed one after another by means of a sector roller 33 to a sheet inlet of the pressing developer 20 after registering the leading end of each sheet on a predetermined position by a developer sheet roller 34 and a resist gate 35.

Accordingly, the pressing developer 20 is supplied with the microcapsule sheet 37 and developer sheet 38 which are integrally overlapped one on the other in such a way that the microcapsule-coated surface of the microcapsule sheet 37 is held in contact with the developer-coated surface of the developer sheet 38. In this state, a pressure is applied on the overlapped sheets, whereupon microcapsules in unexposed areas on the microcapsule sheet 37 are ruptured to bring about reaction between the dye precursor from the ruptured microcapsules and the developer on the developer sheet 38. As a result, a picture image is developed on the developer sheet 38.

The microcapsule sheet 37 and developer sheet 38 coming out of the pressing developer 20 are separated by means of a separator roller 23 to advance upward and straight forward directions, respectively. After acceleration of color development and fixation at a heat fixing station 21, the developer sheet 38 is discharged from the machine onto a discharge tray 27 with the image side of the sheet facing upward. The separated microcapsule sheet 37 is wound on the take-up shaft 25 through a travel regulating roller 24.

The developer sheet supplying apparatus of this embodiment, including the developer sheet cassette 50 and sheet feeder tray 41, is arranged in the following manner.

Figure 1A:
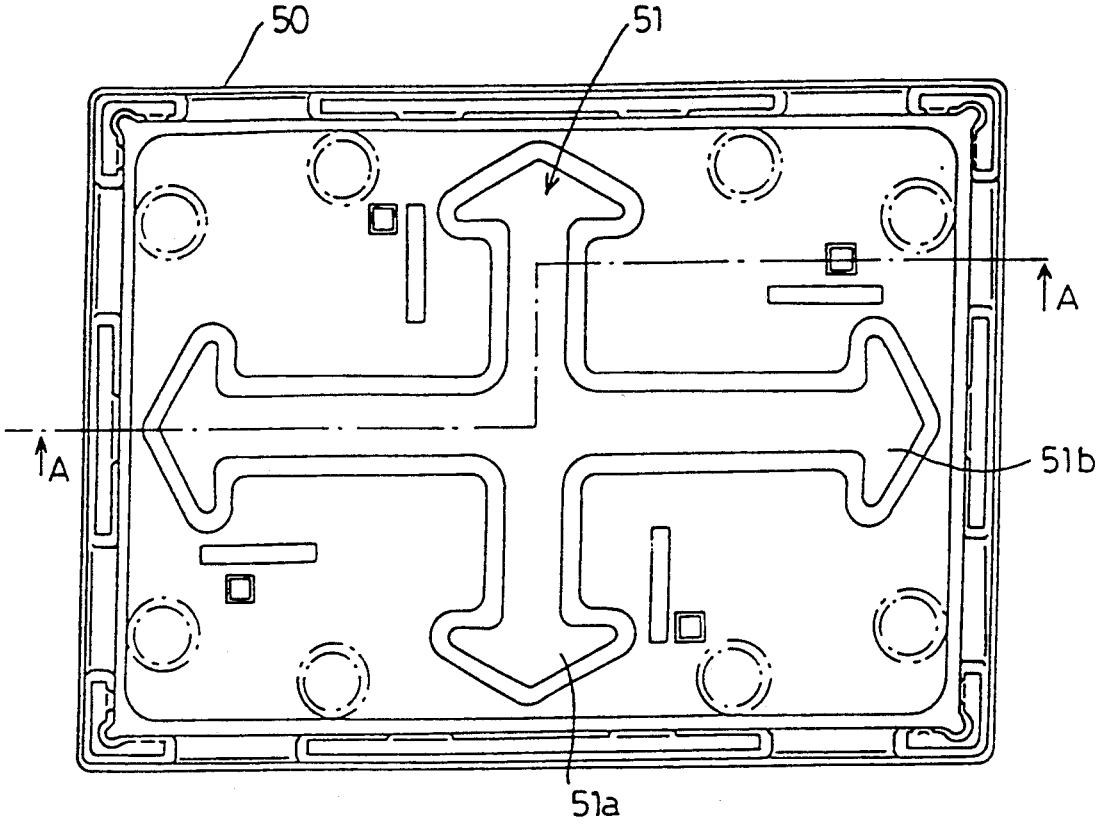
FIG. 1(*a*) is a plan view of a developer sheet cassette.
Figure 1B:
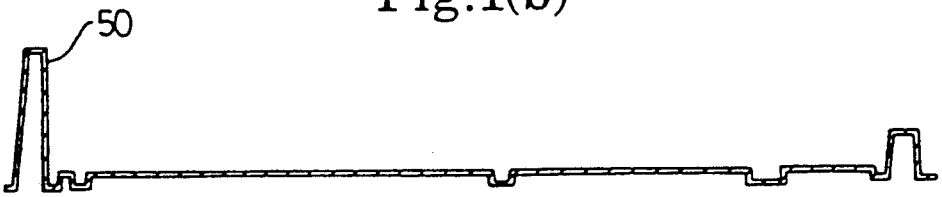

As shown particularly in FIGS. 1(*a*) and 1(*b*), the developer sheet cassette 50 is provided with crossed interlocking grooves 51 on the lower bottom surface thereof, the interlocking grooves 51 being formed in an arrow-like shape at each end.

Figure 3A:
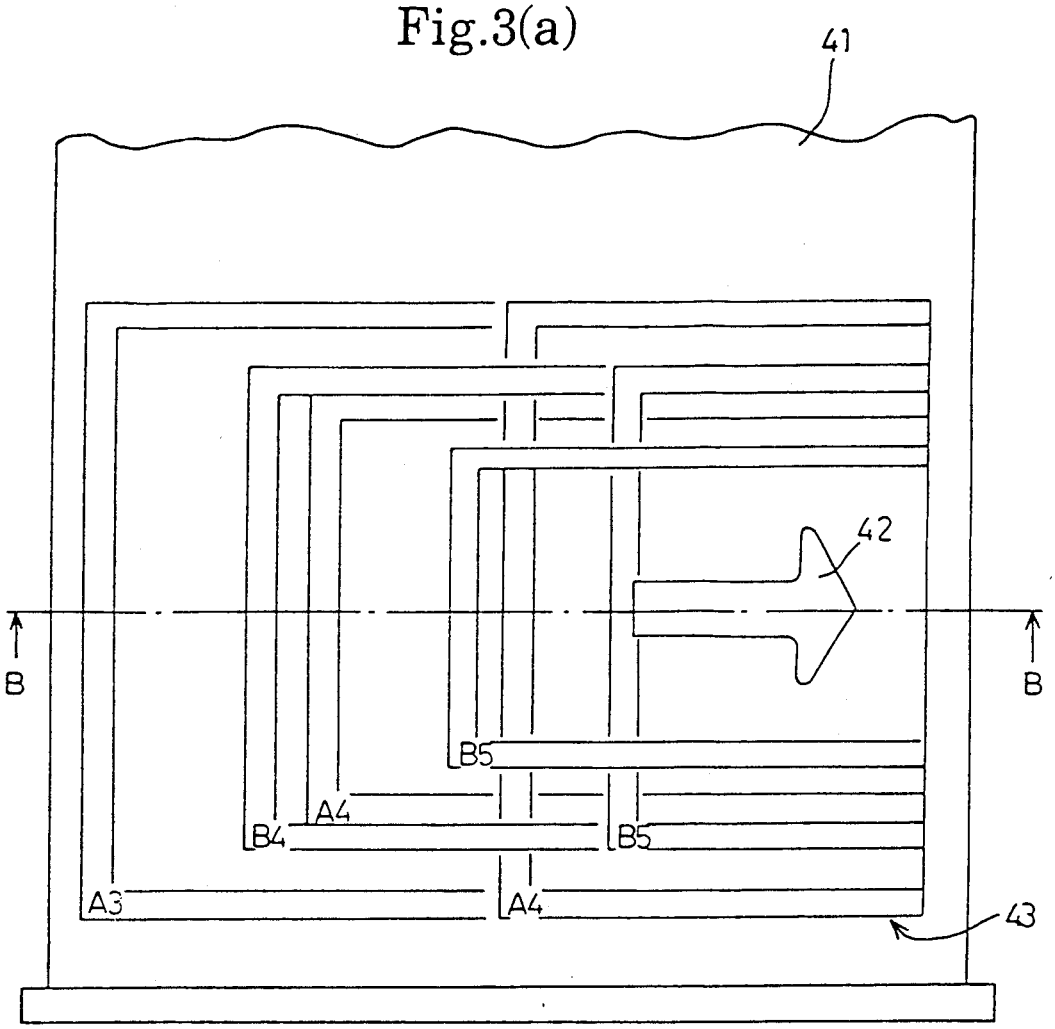
FIG. 3(*a*) is a plan view of the sheet feeder tray.
Figure 3B:
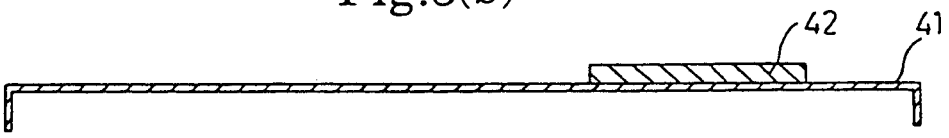

On the other hand, as illustrated in FIGS. 3(*a*) and 3(*b*), the sheet feeder tray 41 is provided with an arrow-shaped positioning protuberance 42 on its top surface for engagement with one of the crossed interlocking grooves 51 on the developer sheet cassette 50. The sheet feeder tray 41 is further provided with a number of fringe marks 43 on its top surface around the positioning protuberance 42 to indicate the marginal edge positions of various developer sheets sizes. Two fringe marks 43 are provided for each developer sheet size to cope with both of widthwise and lengthwise loading positions of the developer sheet cassette 50.

Figure 2:
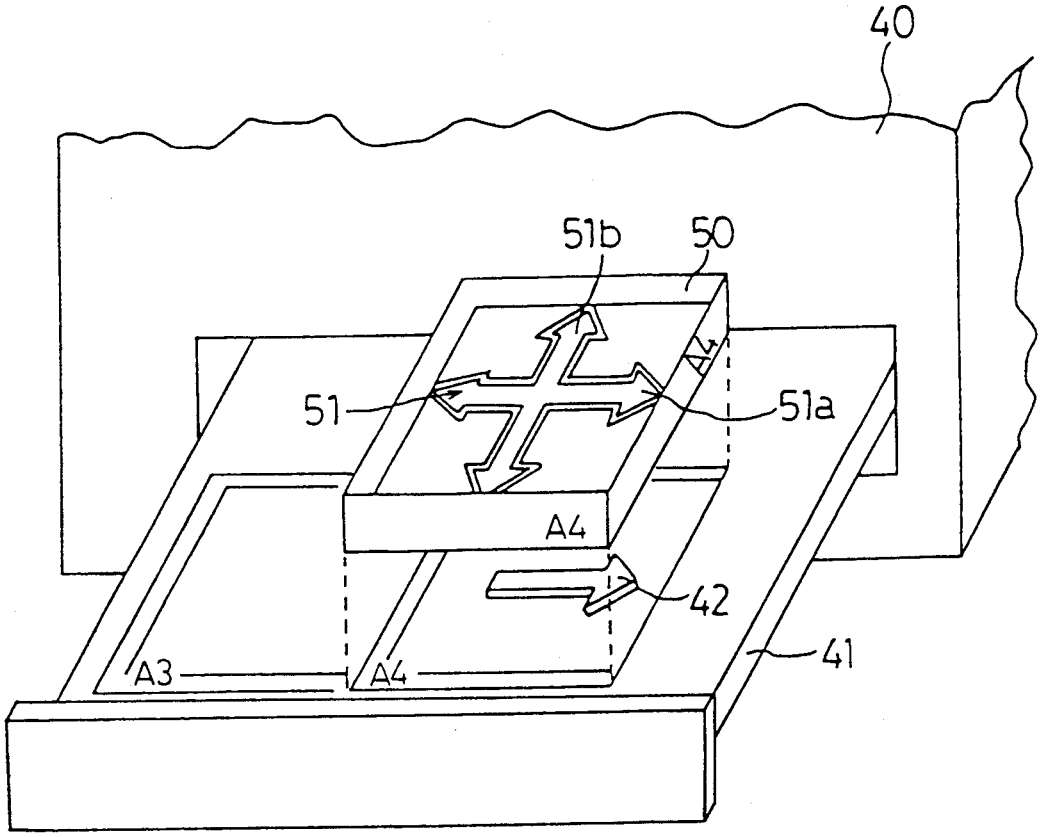
FIG. 2 is a perspective view of a sheet feeder tray in a drawn out state.

The developer sheet cassette 50 is loaded on the copying machine 40 in the manner as follows. After pulling out the sheet feeder tray 41 from the copying machine 40 as shown in FIG. 2, the developer sheet cassette 50 is placed on the sheet feeder tray 41 in such a way that the outer frame of the cassette 50 registers on the fringe mark 43 corresponding to the size of the developer sheets 38 in the cassette 50. Thereafter, one of the interlocking grooves 51 on the developer sheet cassette 50, an interlocking groove 51*a* in this particular example, is engaged with the positioning protuberance 42 on the sheet feeder tray 41 to set the cassette 50 in position on the tray 41. After this, the tray 41 is pushed into the copying machine 40 to complete its loading.

In a case where the developer sheet cassette 50 is used in a widthwise position, another interlocking groove 51*b* is engaged with the positioning protuberance 42, whereupon the cassette 50 is set in the widthwise position on the tray 41.

As clear from the foregoing description, in the developer sheet supplying apparatus of the present embodiment, the developer sheet cassette 50 is firstly registered on the fringe mark 43 on the sheet feeder tray 41, and then one of the crossed interlocking grooves 51 on the lower bottom surface of the cassette 50 is engaged with the positioning protuberance 42 on the sheet feeder tray 41 to set the cassette 50 in position on the tray 41. Accordingly, when loading the cassette 50 of a different size for a change of the developer sheet size or when changing the loading direction of the cassette 50 into the lengthwise or widthwise position, the cassette 50 can be set in position on the tray 41 simply by engagement with the positioning protuberance 42 and in an extremely facilitated manner.

It is to be understood that the present invention is not restricted to the particular embodiment shown above, and various modifications and alterations can be added thereto without departing from the scope of the invention as encompassed by the appended claims. For example, if desired, the fringe marks on the sheet feeder tray 41 may be classified by colors according to the sizes of the developer sheets 38 to indicate the cassette positions more clearly.

What is claimed is:

1. A sheet supplying arrangement for apparatus for processing sheets, comprising:

a removable cassette adapted to store a stack of sheets with a first axis of the sheets extending in a first direction and a second axis of the sheets extending in a second direction;

a sheet feeder tray associated with the sheet processing apparatus for holding said cassette on a top surface thereof;

a pair of interlocking portions provided on the bottom surface of said cassette, one of the interlocking portions extending substantially parallel to the first sheet axis and the other of the interlocking portions extending substantially parallel to the second sheet axis; and a positioning member located on the top surface of said sheet feeder tray for engaging one or the other of said interlocking portions to set said cassette in a predetermined position on said sheet feeder tray.

2. A sheet supplying apparatus as defined in claim 1, wherein said sheet feeder tray is provided with, on the top surface thereof, a fringe mark indicative of the marginal edge position of said cassette to be set one said sheet feeder tray in said first direction, and a fringe mark indicative of the marginal edge position of said cassette to be set on said sheet feeder tray in said second direction.

3. Reproduction apparatus comprising:

means for receiving an original;

means for imaging an original image on a reproduction medium, said reproduction medium including cut sheets; and means for supplying said cut sheets, said supplying means including a tray associated with the reproduction apparatus, orienting means on a top surface of the tray for orienting a cassette placed on the tray, a removable cassette for holding a supply of said cut sheets; locating means on a bottom surface of the cassette for cooperating with the orienting means, the locating means having a pair of locating members, each of the pair of locating members being selectively engagable with the orienting means to position the cassette on the tray in one of two orthogonal positions with respect to the tray.

4. Apparatus as in claim 3, further comprising means for mounting the tray for movement from a cassette loading position to a sheet supply position.

5. Apparatus as in claim 3, wherein the reproduction medium further comprises a web, said imaging means forming a latent image on said web; and means for feeding the cut sheets into contact with said web, said cut sheets comprising means for coacting with the latent image on the web to form a visible image on the cut sheets.

6. Apparatus as in claim 5, wherein the web is a microcapsule type, photosensitive, pressure sensitive recording medium and the cut sheets include developer means for reacting with the contents of he microcapsule to form an image on the cut sheet.

7. Apparatus as in claim 3, wherein the tray includes a pair of indicating means for preliminarily aligning the cassette on the tray in either of two of said orthogonal positions.

8. Apparatus as in claim 7, wherein the indicating means surround the orienting means.

9. Reproduction apparatus comprising:

means for receiving an original;

means for imaging an original image on a reproduction medium, said reproduction medium including cut sheets; and means for supplying said cut sheets, said supplying means including a tray associated with the reproduction apparatus, orienting means on a surface of the tray, a removable cassette for holding a supply of said cut sheets; locating means on the cassette for cooperating with the orienting means to position the cassette on the tray in one of two orthogonal positions with respect to the tray;

wherein the tray includes a pair of indicating means for preliminarily aligning the cassette on the tray in either of two of said orthogonal positions, the indicating means surrounding the orienting means; and wherein the orienting means comprises an upstanding protrusion on the tray and the indicating means comprise marks on the surface of the tray.

10. A sheet supplying arrangement for apparatus for processing sheets, comprising:

a removable cassette adapted to store a stack of sheets;

a sheet feeder tray associated with the sheet processing apparatus for receiving said cassette thereon;

an interlocking member on a bottom surface of said cassette, the interlocking member including intersecting portions; and a positioning member provided on a top surface of said sheet feeder tray and adapted to engage with one or the other of said intersecting portions to orient said cassette in one of two predetermined positions on said sheet feeder tray.

11. A sheet supplying apparatus as defined in claim 10, further comprising marking means on the top surface of the tray, said marking means being indicative of the marginal edge position of a cassette set on said sheet feeder tray in one of said predetermined positions and the marginal edge position of a cassette set on said sheet feeder tray in the other of said predetermined positions.

12. Apparatus as in claim 10, wherein the positioning member includes means for preventing movement of the cassette with respect to the tray in the directions parallel to the intersecting portions of the positioning member.

13. Apparatus as in claim 12, wherein the intersecting portions of the interlocking means intersect orthogonally.

14. Apparatus as in claim 12, further comprising indicator means on the tray for indicating the marginal edge positions of the cassette on the tray in each of two orientations of the cassette with respect to the tray corresponding to the two intersecting portions.

15. Apparatus as in claim 10, wherein the interlocking means comprises a depressed portion formed in the bottom surface of the cassette and the positioning member comprise an upstanding protrusion on the top surface of the tray.

16. Apparatus as in claim 15, wherein the protrusion includes means for interlocking with end portions of each of the intersecting portions.

* * * * *